US008943759B2

(12) United States Patent
Warner et al.

(10) Patent No.: US 8,943,759 B2
(45) Date of Patent: Feb. 3, 2015

(54) DUAL-SIDE UNFOLDABLE BUILDING MODULES

(75) Inventors: Paul Warner, Waltham, MA (US); Elizabeth Rothwell, Somerville, MA (US); Christopher Ryan, Waltham, MA (US)

(73) Assignee: Blu Homes, Inc., Waltham, MA (US)

( * ) Notice: Subject to any disclaimer, the term of this patent is extended or adjusted under 35 U.S.C. 154(b) by 0 days.

(21) Appl. No.: 13/982,026

(22) PCT Filed: Jan. 24, 2012

(86) PCT No.: PCT/US2012/022419

§ 371 (c)(1),
(2), (4) Date: Jul. 26, 2013

(87) PCT Pub. No.: WO2012/103133

PCT Pub. Date: Aug. 2, 2012

(65) Prior Publication Data

US 2013/0305628 A1 Nov. 21, 2013

Related U.S. Application Data

(60) Provisional application No. 61/436,456, filed on Jan. 26, 2011.

(51) Int. Cl.
*E04H 1/12* (2006.01)
*E04B 1/343* (2006.01)
(Continued)

(52) U.S. Cl.
CPC ..... *E04B 1/34357* (2013.01); *E04H 1/12* (2013.01)
USPC ..... 52/79.5; 52/66; 52/71; 52/79.1

(58) Field of Classification Search
CPC ..... E04B 1/34321; E04B 1/34357; E04B 1/3445; E04B 1/343; E04B 1/34315; E04B 1/34384; E04B 1/344; E04B 1/3442; E04B 1/348; E04H 1/12
USPC ..... 52/66, 71, 79.3, 79.5, 646
See application file for complete search history.

(56) References Cited

U.S. PATENT DOCUMENTS 1,886,962 A * 11/1932 La Roche ..... 52/236.7
2,291,472 A 7/1942 Johnston (Continued)

FOREIGN PATENT DOCUMENTS

AU 460549 4/1975
CA 908382 A 8/1972

(Continued)

OTHER PUBLICATIONS

Notification of Transmittal of the International Search Report and the Written Opinion of the International Searching Authority, or the Declaration; International Application No. PCT/US2010/050041, entitled "Foldable Building Units", International Filing Date: Sep. 23, 2010, Date of Mailing: Jan. 31, 2011.

(Continued)

*Primary Examiner* — Charles A Fox
*Assistant Examiner* — Joseph J Sadlon
(74) *Attorney, Agent, or Firm* — Hamilton, Brook, Smith & Reynolds, P.C.

(57) ABSTRACT

Dual-side unfolding building modules are described that allow buildings with greater design flexibility, and particularly, large and open work or living spaces while allowing interesting roof designs such as butterfly type roofs. The building modules fold compactly for transport. The building modules can be prefabricated with interior and exterior finishing material thereby reducing the time required for finishing at the building site.

3 Claims, 7 Drawing Sheets

(51) Int. Cl.

| | |
|---|---|
| *E04H 1/00* | (2006.01) |
| *E04H 3/00* | (2006.01) |
| *E04H 5/00* | (2006.01) |

(56) References Cited

U.S. PATENT DOCUMENTS

| | | | | |
|---|---|---|---|---|
| 2,592,410 | A | 4/1952 | Shumaker | |
| 2,920,920 | A * | 1/1960 | Couse et al. | 296/26.02 |
| 3,189,949 | A * | 6/1965 | Hurkamp | 52/2.11 |
| 3,253,371 | A | 5/1966 | Honold et al. | |
| 3,338,005 | A | 8/1967 | Gelsavage | |
| 3,348,344 | A | 10/1967 | Tatevossian | |
| 3,714,749 | A | 2/1973 | Aitken | |
| 3,774,356 | A | 11/1973 | Philip | |
| 3,777,425 | A * | 12/1973 | Le Bourgeois | 52/2.23 |
| 3,782,063 | A | 1/1974 | Batorewicz et al. | |
| 3,792,667 | A * | 2/1974 | Paton | 105/404 |
| 3,832,811 | A | 9/1974 | Briel, Jr. | |
| 3,835,600 | A | 9/1974 | Padula et al. | |
| 3,844,083 | A | 10/1974 | Farley, Jr. | |
| 3,969,869 | A | 7/1976 | Partridge | |
| 3,971,185 | A | 7/1976 | Hendrich | |
| 3,984,948 | A | 10/1976 | Bussard | |
| 3,984,953 | A * | 10/1976 | Kump | 52/143 |
| 4,085,762 | A | 4/1978 | O'Brien et al. | |
| 4,235,054 | A | 11/1980 | Cable et al. | |
| 4,479,333 | A | 10/1984 | Hendrich | |
| 4,534,141 | A * | 8/1985 | Fagnoni | 52/68 |
| 4,545,171 | A | 10/1985 | Colvin | |
| 4,546,578 | A | 10/1985 | Behrmann | |
| 4,588,190 | A | 5/1986 | Stewart et al. | |
| 4,635,412 | A | 1/1987 | LePoittevin | |
| 4,660,332 | A | 4/1987 | Colvin, Jr. | |
| 4,662,146 | A | 5/1987 | Parry | |
| 4,689,924 | A | 9/1987 | Jurgensen | |
| 4,715,159 | A | 12/1987 | Hijazi | |
| 4,726,155 | A | 2/1988 | Nahmias | |
| 4,742,653 | A | 5/1988 | Napier et al. | |
| 4,891,919 | A | 1/1990 | Palibroda | |
| 4,903,637 | A | 2/1990 | Devault | |
| 4,912,891 | A | 4/1990 | Bertrand | |
| 4,942,686 | A | 7/1990 | Kemeny | |
| 5,107,639 | A * | 4/1992 | Morin et al. | 52/71 |
| 5,237,784 | A | 8/1993 | Ros | |
| 5,349,793 | A * | 9/1994 | Bigelow, Jr. | 52/143 |
| 5,398,498 | A | 3/1995 | Mort et al. | |
| 5,444,944 | A | 8/1995 | Roelofsz | |
| 5,461,832 | A | 10/1995 | Smith | |
| 5,611,449 | A | 3/1997 | Pedersen | |
| 5,657,606 | A | 8/1997 | Ressel et al. | |
| 5,761,854 | A | 6/1998 | Johnson et al. | |
| 5,785,904 | A * | 7/1998 | Abou-Rached | 264/35 |
| 5,960,593 | A | 10/1999 | Murphy | |
| 5,966,956 | A | 10/1999 | Morris et al. | |
| 6,125,608 | A | 10/2000 | Charlson | |
| 6,185,878 | B1 * | 2/2001 | Bullard et al. | 52/79.5 |
| 6,345,471 | B1 | 2/2002 | Gyllenhammar | |
| 6,434,895 | B1 | 8/2002 | Hosterman et al. | |
| 6,460,297 | B1 | 10/2002 | Bonds et al. | |
| 6,550,209 | B2 | 4/2003 | Meguro et al. | |
| 6,651,393 | B2 * | 11/2003 | Don et al. | 52/79.5 |
| 6,749,252 | B2 | 6/2004 | Cervenka | |
| 6,892,504 | B1 | 5/2005 | diGirolamo et al. | |
| 6,983,567 | B2 | 1/2006 | Ciotti | |
| 7,418,802 | B2 | 9/2008 | Sarine et al. | |
| 7,475,514 | B2 | 1/2009 | Rulquin et al. | |
| 7,562,508 | B2 | 7/2009 | Dickinson et al. | |
| 7,637,060 | B2 | 12/2009 | Starheim et al. | |
| 7,647,731 | B2 * | 1/2010 | Muir | 52/79.5 |
| 7,658,039 | B2 | 2/2010 | Ziegelman | |
| 7,841,136 | B2 | 11/2010 | Czyznikiewicz | |
| 7,895,794 | B2 | 3/2011 | Pope | |
| 7,921,608 | B2 | 4/2011 | Bucher et al. | |
| 7,931,164 | B2 | 4/2011 | Krohn | |
| 8,020,347 | B2 * | 9/2011 | Mower et al. | 52/79.1 |
| 8,151,537 | B2 * | 4/2012 | Pope | 52/745.02 |
| 8,156,691 | B2 | 4/2012 | Dickson et al. | |
| 8,201,362 | B2 | 6/2012 | Alford et al. | |
| 8,286,391 | B2 | 10/2012 | Yang et al. | |
| 8,322,086 | B2 | 12/2012 | Weber | |
| 8,347,560 | B2 | 1/2013 | Gyory et al. | |
| 8,739,475 | B2 | 6/2014 | Michaud et al. | |
| 2001/0059967 | | 7/2001 | Meguro et al. | |
| 2002/0007605 | A1 | 1/2002 | Cohen et al. | |
| 2002/0062605 | A1 | 5/2002 | Matthews | |
| 2003/0145537 | A1 | 8/2003 | Bailey | |
| 2004/0083671 | A1 | 5/2004 | Johnson et al. | |
| 2004/0194396 | A1 | 10/2004 | Shanni | |
| 2005/0044804 | A1 | 3/2005 | Bin et al. | |
| 2005/0210764 | A1 | 9/2005 | Foucher et al. | |
| 2005/0284035 | A1 | 12/2005 | DeOvando et al. | |
| 2006/0053701 | A1 | 3/2006 | Loesch | |
| 2006/0059792 | A1 | 3/2006 | Tiramani | |
| 2006/0225369 | A1 | 10/2006 | Napier | |
| 2007/0074462 | A1 * | 4/2007 | Linares | 52/79.1 |
| 2007/0079573 | A1 | 4/2007 | Sarine et al. | |
| 2008/0141495 | A1 * | 6/2008 | Fisher | 16/343 |
| 2008/0163564 | A1 | 7/2008 | Jarski | |
| 2008/0236055 | A1 | 10/2008 | Laprise | |
| 2009/0193725 | A1 | 8/2009 | Harrisson et al. | |
| 2009/0313925 | A1 | 12/2009 | Lyons et al. | |
| 2010/0043308 | A1 | 2/2010 | Keeble | |
| 2010/0064601 | A1 | 3/2010 | Napier | |
| 2010/0218436 | A1 | 9/2010 | Colquhoun | |
| 2011/0214362 | A1 | 9/2011 | Huang | |
| 2012/0151851 | A1 * | 6/2012 | Cantin et al. | 52/79.5 |
| 2012/0186166 | A1 | 7/2012 | Casto | |
| 2012/0255240 | A1 | 10/2012 | Shen | |
| 2012/0279142 | A1 | 11/2012 | Michaud | |
| 2012/0311939 | A1 | 12/2012 | Olaya | |
| 2012/0317898 | A1 | 12/2012 | Strachan et al. | |
| 2013/0014450 | A1 | 1/2013 | Esposito | |
| 2013/0133273 | A1 | 5/2013 | Michaud et al. | |
| 2013/0192146 | A1 | 8/2013 | Anklam | |
| 2013/0192147 | A1 | 8/2013 | Schaffert | |
| 2013/0232887 | A1 | 9/2013 | Donnini | |
| 2013/0269267 | A1 | 10/2013 | Tiramani | |
| 2013/0305628 | A1 | 11/2013 | Warner et al. | |
| 2014/0059947 | A1 | 3/2014 | Rothwell et al. | |

FOREIGN PATENT DOCUMENTS

| | | | | |
|---|---|---|---|---|
| CA | 962422 | | 2/1975 | |
| CA | 2 591 949 | | 6/2006 | |
| CN | 2270088 | | 12/1997 | |
| DE | 7102932 | U | 1/1971 | |
| DE | 2364021 | A1 | 3/1975 | |
| EP | 1 775 396 | A1 | 4/2007 | |
| EP | 1 975 329 | A1 | 10/2008 | |
| FR | 2930569 | A1 * | 10/2009 | |
| GB | 330609 | | 6/1930 | |
| GB | 449755 | | 6/1936 | |
| GB | 1021 625 | | 3/1966 | |
| GB | 1 343 437 | | 1/1974 | |
| GB | 2029474 | A | 3/1980 | |
| GB | 1 581 581 | A | 12/1980 | |
| GB | 2 296 728 | A | 7/1996 | |
| GB | 2350131 | A | 11/2000 | |
| GB | 2415713 | A | 1/2006 | |
| WO | WO 8604630 | A1 * | 8/1986 | E04B 1/344 |
| WO | WO 8908754 | A1 * | 9/1989 | E04B 1/343 |
| WO | WO 91/02869 | | 3/1991 | |
| WO | WO 93/20297 | | 10/1993 | |
| WO | WO 9713931 | A1 * | 4/1997 | E04B 1/344 |
| WO | WO 9802626 | A1 * | 1/1998 | E04B 1/344 |
| WO | WO 02/066755 | A1 | 8/2002 | |
| WO | WO 2007/033498 | A1 | 3/2007 | |
| WO | WO 2008/009039 | A1 | 1/2008 | |
| WO | WO 2009/059432 | A1 | 5/2009 | |

(56) References Cited

FOREIGN PATENT DOCUMENTS

| | | | |
|---|---|---|---|
| WO | WO 2009/126985 | A1 | 10/2009 |
| WO | WO 2010/057313 | A1 | 5/2010 |

OTHER PUBLICATIONS

Jetson Green, Blu Perfects Iconic Breezehouse Prefab, [online] http:///www.jetsongreen.com/2011/01/blu-perfects-icon-breeze-way-house.html; [Retrieved from the Internet on Jan. 23, 2012.].

Notification Concerning Transmittal of International Preliminary Report on Patentability, International Application No. PCT/US2010/050041, International Filing Date: Sep. 23, 2010, entitled "Foldable Building Units", Date of Mailing: Apr. 5, 2012.

International Search Report and the Written Opinion of the International Searching Authority, or the Declaration, International Application No. PCT/US2011/054348, entitled "Buildings Formed From Complementary Building Modules, and Methods for Building Same", International Filing Date: Sep. 30, 2011, Date of Mailing: Aug. 16, 2012.

International Search Report and the Written Opinion of the International Searching Authority, or the Declaration, International Application No. PCT/US2011/029643, entitled "Foldable Building Units", International Filing Date: Mar. 23, 2011; Date of Mailing: May 23, 2011.

International Preliminary Report on Patentability, International Application No. PCT/US2011/029643, entitled "Foldable Building Units", International Filing Date: Mar. 23, 2011; Date of Mailing: Feb. 21, 2013.

International Preliminary Report on Patentability, International Application No. PCT/US2011/054348, entitled "Buildings Formed From Complementary Building Modules, and Methods for Building Same", International Filing Date: Sep. 30, 2011; Date of Mailing: Apr. 11, 2013.

International Search Report and the Written Opinion of the International Searching Authority, or the Declaration, International Application No. PCT/US2012/022419, entitled "Dual-Side Unfoldable Building Modules", International Filing Date: Jan. 24, 2012; Date of Mailing: May 4, 2012.

International Preliminary Report on Patentability, International Application No. PCT/US2012/022419, entitled "Dual-Side Unfoldable Building Modules", International Filing Date: Jan. 24, 2012; Date of Mailing: Aug. 8, 2013.

Office Action, U.S. Appl. No. 13/498,093, entitled "Foldable Building Units", filed Sep. 23, 2010, Date of Mailing: Jan. 25, 2013.

Office Action, U.S. Appl. No. 13/498,093, entitled "Foldable Building Units", filed Sep. 23, 2010, Date of Mailing: Nov. 6, 2013.

Office Action U.S. Appl. No. 13/814,326 entitled "Foldable Building Units", filed Feb. 5, 2013, Date of Mailing: Sep. 12, 2013.

Notice of Allowance and Fee(s) Due, U.S. Appl. No. 13/814,326, filed Feb. 5, 2013, entitled "Foldable Building Units", Date of Mailing: Mar. 4, 2014.

Office Communcaton, U.S. Appl. No. 13/498,093, filed Mar. 23, 2012, date of communication: Jun. 10, 2014.

Office Communication, U.S. Appl. No. 13/877,096, filed Nov. 15, 2013, entitled "Buildings Formed From Complementary Building Modules, And Methods For Building Same", date of communication: Sep. 29, 2014.

Office Communication, U.S. Appl. No. 13/498,093, filed Mar. 23, 2012, entitled "Foldable Building Units", date of communication: Sep. 26, 2014.

* cited by examiner

DUAL-SIDE UNFOLDABLE BUILDING MODULES

RELATED APPLICATION

This application is the U.S. National Stage of International Application No. PCT/US2012/022419, filed Jan. 24, 2012, which designates the U.S., published in English, and claims the benefit of U.S. Provisional Application 61/436,456, filed Jan. 26, 2011. The entire teachings of the above applications are incorporated herein by reference.

BACKGROUND OF THE INVENTION

Foldable buildings have been described in the literature; however, very few have been built. Reasons that have hindered commercialization of foldable buildings include the presumed limited design capabilities and difficulty of designing buildings that have sufficiently large and interesting floor plans, and particularly, high ceilings and wide open spaces, while having corresponding compact and easily transportable folded configurations.

There is, therefore, a need for foldable buildings that exhibit more design flexibility, are formed from easily transported folding building modules, and allow buildings that are substantially in finished condition.

SUMMARY OF THE INVENTION

The buildings and, particularly, houses of the present invention are formed from the aforementioned building modules. These building modules allow for large spaces with high ceilings and when connected with one or more further building modules as described herein allows houses and buildings that exhibit large floor planes with great design flexibility. The aforementioned building modules are formed from easily transported building modules, and can be prefabricated with interior and exterior finishing material thereby reducing the time required for finishing at the building site.

A first embodiment of the present invention is a building module. The building module comprises (a) a first external wall section having a first wall frame element foldably connected to a second wall frame; in unfolded configuration, the first wall frame element providing a bottom part of the first external wall section and the second wall frame element providing a top part of the first external wall section; (b) a second external wall section having a third wall frame element foldably connected to a fourth wall frame; in unfolded configuration, the third wall frame element providing a bottom part of the second external wall section and the fourth wall frame element providing a top part of the second external wall section; and (c) a ceiling structure connected to respective structural support structures, the ceiling structure being positioned in lengthwise orientation from a side of the building module between the first and second external wall sections to a corresponding opposing side of the building module between the first and second wall sections. The structural support members each are connected to a core floor frame, and the first external wall section and the second external wall section are interconnected through one or more frames including the core floor frame.

A second embodiment of the present invention is a building module. The building module comprises (a) a first external wall section having a first wall frame element foldably connected to a second wall frame element through a hinge between a structural steel member of the first wall frame element and a structural steel member of the second wall frame; in unfolded configuration, the first wall frame element providing a bottom part of the first external wall section and the second wall frame element providing a top part of the first external wall section; (b) a second external wall section having a third wall frame element foldably connected to a fourth wall frame element through a hinge between a structural steel member of the third wall frame element and a structural steel member of the fourth wall frame; in unfolded configuration, the third wall frame element providing a bottom part of the second external wall section and the fourth wall frame element providing a top part of the second external wall section; (c) a first floor frame element foldably connected to the first wall frame element through a hinge between a structural steel member of the first floor frame element and a structural steel member of the first wall frame; (d) a second floor frame element foldably connected to the third wall frame element through a hinge between a structural steel member of the second floor frame element and a structural steel member of the third wall frame element; (e) a ceiling structure connected to respective structural support structures which are connected to a core floor frame element, the ceiling structure having a top surface that is substantially equidistant from the core floor along the ceiling structure, and the ceiling structure being substantially parallel to the first external wall section and the second external wall section;

the first external wall section and the second external wall section are interconnected through one or more frame elements including the first floor frame element, the core floor frame element and the second floor frame element, and, in unfolded configuration of the building module, the first and second external wall sections each independently extend higher than the ceiling structure.

A third embodiment of the present invention is a folded building module. The folded building module comprises (a) a first external wall section having a first wall frame element foldably connected to a second wall frame element; in unfolded configuration, the first wall frame element providing a bottom part of the first external wall section and the second wall frame element providing a top part of the first external wall section; (b) a second external wall section having a third wall frame element foldably connected to a fourth wall frame element; in unfolded configuration, the third wall frame element providing a bottom part of the second external wall section and the fourth wall frame element providing a top part of the second external wall section; (c) structural support structures for connecting to one or more ceiling beams, wherein the structural support members each are connected to a core floor frame element and the structural support members are positioned between the second wall frame element and the fourth wall frame element to allow the one or more ceiling beams to be positioned in lengthwise orientation from a side of the building module between the first and second external wall sections to a corresponding opposing side of the building module between the first and second wall sections; (d) a first floor frame element foldably connected to the first wall frame element; and (e) a second floor frame element foldably connected to the third wall frame element; wherein the first external wall section and the second external wall section are interconnected through one or more frame elements including the first floor frame element, the core floor frame element and the second floor frame element; the first floor frame element, the first wall frame element and the second wall frame element are substantially coplanar; and the second floor frame element, the third wall frame element and the fourth wall frame element are substantially coplanar in folded configuration of the building module.

A fourth embodiment of the present invention is a method for forming an unfolded building module. The method includes (a) unfolding a first floor panel into a position substantially coplanar to the ground; (b) unfolding a second floor panel into a position substantially coplanar to a foundation or the ground, the first and second floor panels being on opposite sides of a core floor panel; (c) unfolding a first exterior wall section from a first wall panel foldably connected to a second wall panel, the first wall panel being foldably connected to the first floor panel, and, in unfolded configuration, forming a fixed connection between the first floor panel and the first wall panel, and forming a fixed connection between the first wall panel and the second wall panel, the first wall panel providing a bottom part of the first wall section and the second wall panel providing a top part of the first wall section; (d) positioning a ceiling structure on respective structural support members in lengthwise orientation from a side of the building module between the first and and a second wall sections to a corresponding opposing side of the building module between the first and second wall sections;

wherein the structural support members each are connected to a core floor panel, the first wall section and the second wall section are interconnected through one or more panels including the first floor panel, the core floor panel and the second floor panel.

A fifth embodiment of the present invention is a building. The building includes a building module as described above in unfolded configuration and with roof panels connected between the external wall sections and the central beam. It further includes a first building unit connected to the side of the unfolded building module between the first and second external wall sections; and a second building unit connected to the corresponding opposing side of the building module between the first and second wall sections.

A sixth embodiment of the present invention is a building. The building includes a building module as described above in unfolded configuration and with roof panels connected between the external wall sections and at least one central beam. The building further includes a first wall panel connected to the side of the unfolded building module between the first and second external wall sections; and a second wall panel connected to the corresponding opposing side of the building module between the first and second wall sections.

A seventh embodiment of the present invention is a folded building module. The folded building module includes a core floor panel, a first floor panel foldably connected to the core floor panel, a first wall panel foldably connected to the first floor panel, a second wall panel foldably connected to the first wall panel, a second floor panel foldably connected to the core floor panel, a third wall panel foldably connected to the second floor panel, a fourth wall panel foldably connected to the third wall panel, and support structures in fixed connection to the core floor frame. The first floor panel, the second floor panel, the first wall panel, the second wall panel, the third wall panel and the fourth wall panel are substantially coplanar. The building module when unfolded, has a first wall section formed from the first wall panel and the second wall panel, and a second wall section formed from the third wall panel and the fourth wall panel, the first wall section and the second wall section being on opposite sides of the building module, the support structures and wall sections being adapted to support and connect to a plurality of roof panels and dimensioned to form a roof that has a downward slope from the wall sections towards the center of the building module (in cross-sectional view as shown, e.g., for the exemplary embodiment shown in FIGS. 2A to H), thereby providing a volume within the unfolded building module between the wall sections and free of structural steel members.

An eighth embodiment of the present invention is a building module. The building module comprises (a) a first external wall section having a first wall frame element foldably connected to a second wall frame element; in unfolded configuration, the first wall frame element providing a bottom part of the first external wall section and the second wall frame element providing a top part of the first external wall section;

(b) a second external wall section including a third wall frame element; and (c) a ceiling structure connected to respective structural support structures, the ceiling structure being positioned in lengthwise orientation from a side of the building module between the first and second external wall sections to a corresponding opposing side of the building module between the first and second wall sections;

wherein the structural support members each are connected to a core floor frame element, the first external wall section and the second external wall section are interconnected through one or more frame elements including the core floor frame element.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

The building modules of the present invention allow large and open spaces while allowing interesting roof designs such as butterfly type roofs. Additionally, an about 20' wide building module can be folded and shipped at a width of about 8'6" which greatly reduces transportation cost.

Several houses using the building technology described herein have been built. These houses include a building module of the present invention, for example, as shown in FIG. 1.

Figure 1:
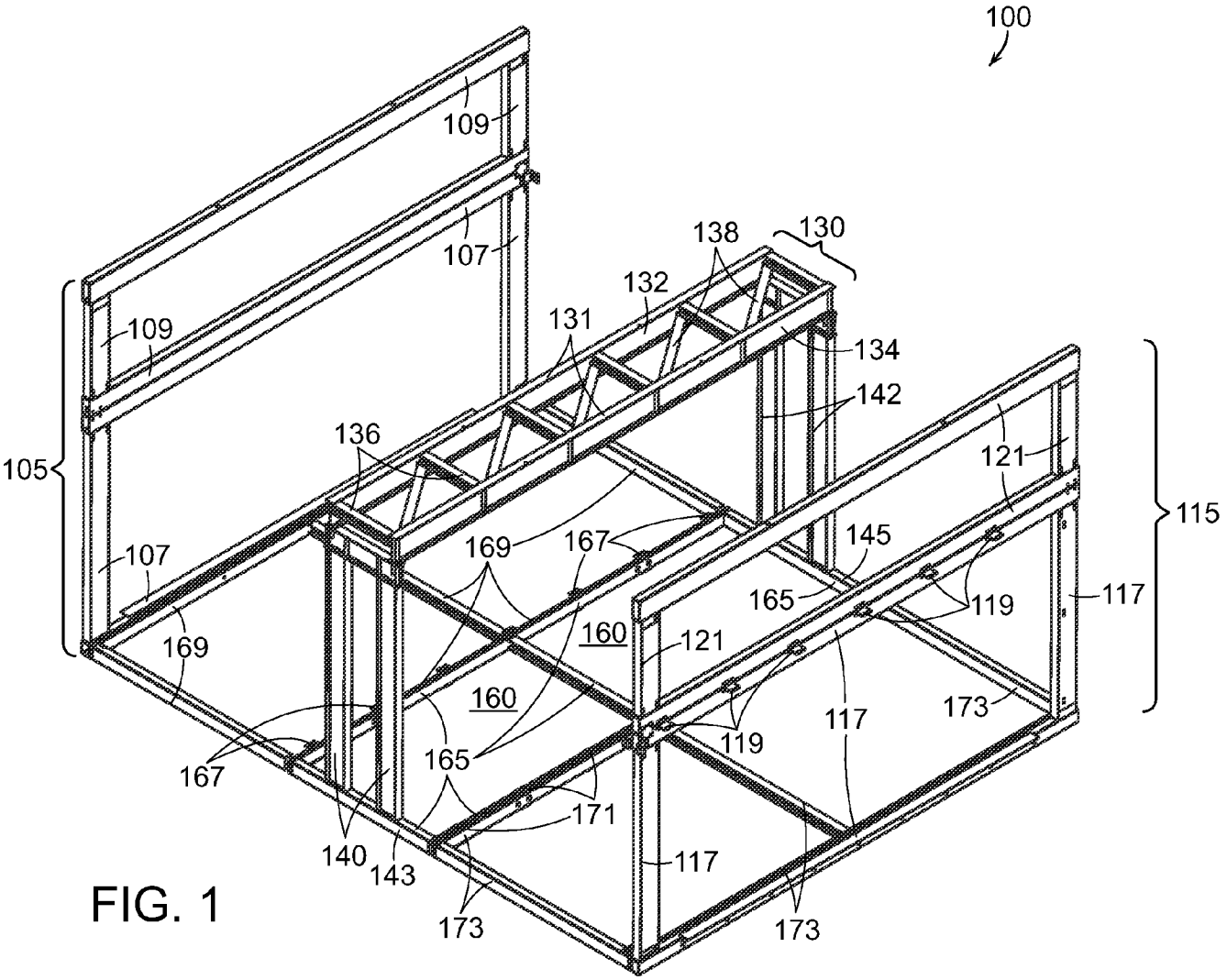
FIG. 1 is a schematic isometric view of the structural frame of a building module in unfolded configuration according to an exemplary embodiment of the present invention.

FIG. 1 is a schematic isometric view of a building module 100 in unfolded configuration according to an exemplary embodiment of the present invention. The building module 100 has a first external wall section 105 having a first structural steel wall frame element 107 foldably connected with metal hinges (not visible in this view of the building module) to a second structural steel wall frame element 109. In unfolded configuration, as shown here, the first structural steel wall frame element 107 provides a bottom part of the first external wall section 105 and the second structural steel wall frame element 109 provides a top part of the first external wall section 105. The building module further has a second external wall section 115 having a third structural steel wall frame element 117 foldably connected with metal hinges 119 to a fourth structural steel wall frame element 121. In unfolded configuration, as shown here, the third structural steel wall frame element 117 provides a bottom part of the second external wall section 115 and the fourth structural steel wall frame element 121 provides a top part of the second external wall section 115. The building module further has a ceiling steel structure 130 formed in this embodiment from two connected structural steel ceiling beams 132 and 134, specifically, two structural steel I-beams. The two ceiling beams 132 and 134 are connected with perpendicular steel members 136 (e.g., six perpendicular steel members as shown here) and diagonal steel members 138 (e.g., five diagonal steel members as shown here). The ceiling structure 130 is connected to respective structural support structures, here, a pair of two adjacent structural steel I-beams 140 on one open side of the building module opposing a corresponding pair of two adjacent structural steel I-beams 142 on a second open side of the building module. In this embodiment, the ceiling beams 132 and 134, the perpendicular steel members 136, the diagonal steel members 138, and the support structures 140 and 142 are part of a core structure that does not include foldable structural steel members, and can be a core part of the respective folded building module. In other embodiments, the ceiling beams 132 and 134 can be foldably connected with metal hinges to the respective structural support structures, and the ceiling structure 130 is formed by unfolding the ceiling beams 132 and 134 upward and then forming a fixed connection between the ceiling beams 132 and 134 and the respective support structures, and connecting optional perpendicular steel members 136 and diagonal steel members 138. Alternatively, the ceiling beams 132 and 134 can be absent in the folded building module and can be connected at the building site. In the embodiment of FIG. 1, the ceiling structure 130 is positioned in lengthwise orientation from a side of the building module between the first and second external wall sections 105 and 115 to a corresponding opposing side of the building module between the first and second wall sections 105 and 115. More specifically, the ceiling structure 130 has a top surface 131, in this embodiment provided by respective top surfaces of the two ceiling beams 132 and 134, and the top surface is substantially equidistant from a core floor 160 lengthwise along the ceiling structure. Further, the ceiling structure is substantially parallel to the first external wall section 105 and the second external wall section 115, and the ceiling structure is substantially centered between the first external wall section 105 and the second external wall section 115. The structural support structures 140 and 142 each are connected to a core floor frame element 165 (140 being connected to outer structural steel member 143 of the core floor frame element 165 and 142 being connected to outer structural steel member 145 of the core floor element 165; note that part of the core floor frame element is hidden in this view by parts of the structural members of wall frame elements 117 and 121), and the first external wall section 105 and the second external wall section 115 are interconnected through one or more structural steel members, specifically here, three structural steel floor frame elements, the core floor frame element 165 which is foldably connected with metal hinges 167 (e.g., seven metal hinges as shown here) to a first floor frame element 169 and foldably connected with metal hinges 171 (e.g., seven metal hinges as in this embodiment, noting that four of the metal hinges are not visible in this view of the building module) to a second floor frame element 173. In fully folded configuration the foldably connected frame elements arrange compactly, similarity to the building module shown in FIG. 2A and leave substantially all of the central volume open (e.g., if an open design is desired) or available for other parts to be prefabricated and finished in the core volume. Additionally, in fully folded configuration, the exterior sides of the foldable floor frame elements 169 and 173 (and respective finished floor panels) provide a wall of the folded module, which increases structural stability of the building module in folded configuration, protects the other folded frame elements such as wall frame elements 107, 109, 117 and 121 (and respective wall panels) as well as prefabricated and finished parts in the core volume, and thereby facilitates transportation of the building module.

Figure 2B:
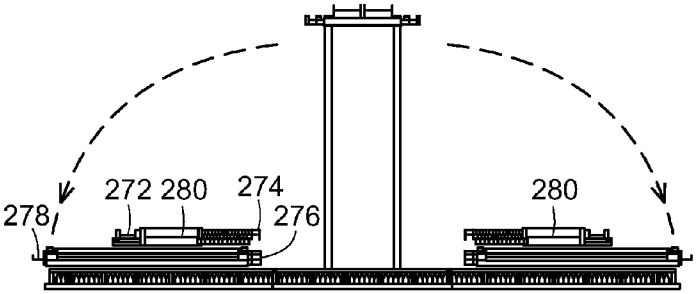
FIGS. 2A-2H are schematic cross-sectional views illustrating (i) the unfolding process of an exemplary building module of the present invention from a folded configuration shown in FIG. 2A (configuration (1)) to an unfolded configuration shown in FIG. 2F (configuration (6)), and (ii) the coupling of roof panels to the unfolded building module shown in FIG. 2F (configuration (6)) to the building module 220 shown in FIG. 2H (configuration (8)).
Figure 2D:
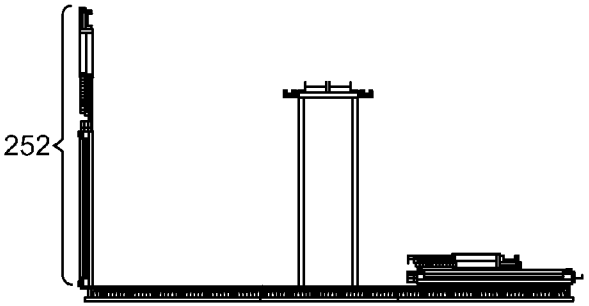
Figure 2A:
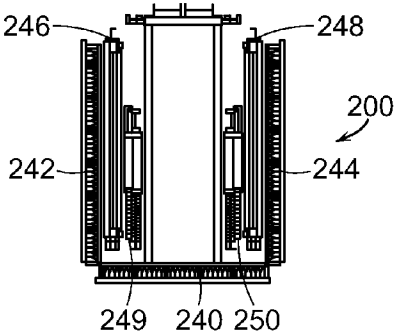
Figure 2C:
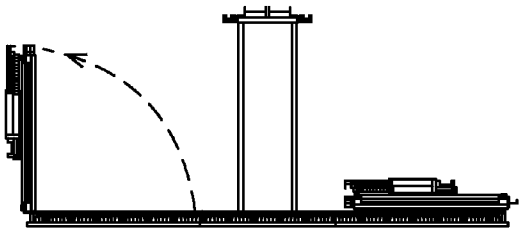
Figure 2F:
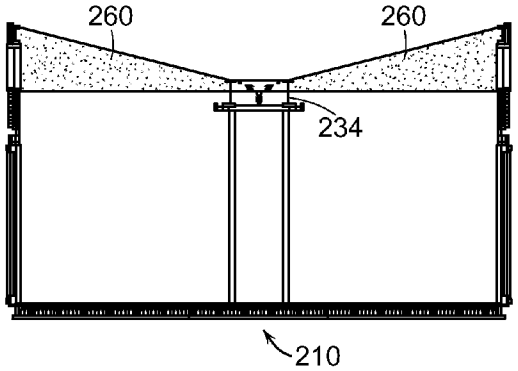
Figure 2H:
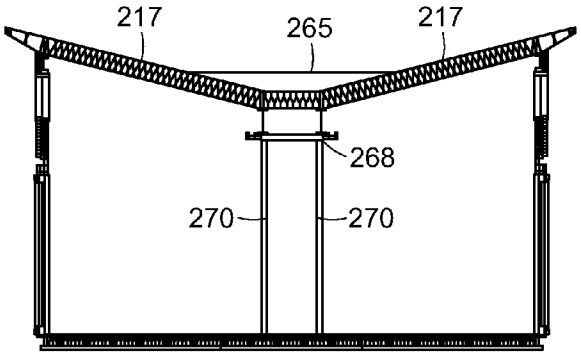
Figure 2E:
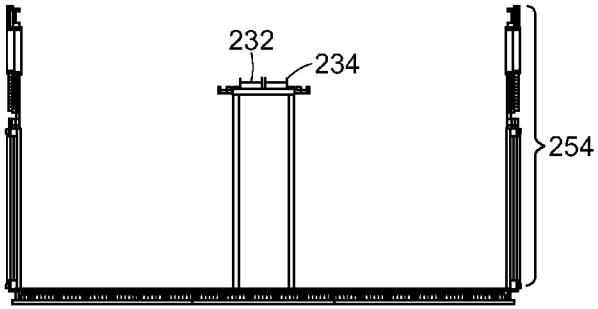
Figure 2G:
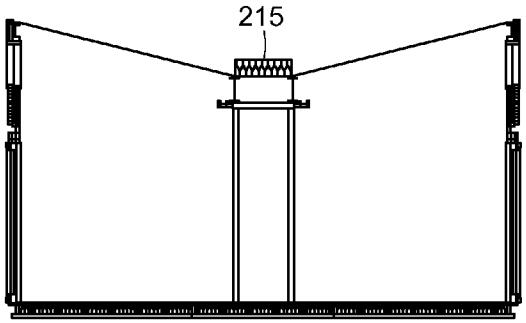

FIGS. 2A-2H are schematic cross-sectional views illustrating (i) the unfolding process of an exemplary building module of the present invention from a folded configuration 200 shown in FIG. 2A to an unfolded configuration 210 shown in FIG. 2F, and (ii) the coupling of roof panels 215 and 217 to the unfolded building module 210 shown in FIG. 2F to the building module 220 shown in FIG. 2H. The unfolded building module 210 has a rectangular floor analogously to the one shown for the building module in FIG. 1. Whereas the building module of FIG. 1 exhibits fixed structural steel ceiling beams 132 and 134, the building module of FIGS. 2A-2H exhibits structural steel ceiling beams, specifically, steel I-beams 232 and 234, foldably connected with hinges (not visible in this view) to respective structural support structures (not visible in this view, and analogous to the support structures 140 and 142 in FIG. 1). The ceiling beams 232 and 234 unfold upwards from a folded configuration as shown, for example, in FIG. 2E to an unfolded configuration shown, for example, in FIG. 2F. Further, whereas the building module of FIG. 1 shows wall and floor frame elements, FIGS. 2A-2H shows wall and floor panels which include respective wall and floor frame elements. The folded building module 200 has a core floor panel 240, foldably connected with hinges (not visible in this view) to a first floor panel 242 and a second floor panel 244. The first floor panel 242 is foldably connected with hinges (not visible in this view) to a first wall panel 246. The second floor panel 244 is foldably connected with hinges (not visible in this view) to a third wall panel 248. The first wall panel 246 is foldably connected with hinges (not visible in this view) to a second wall panel 249. The third wall panel 248 is foldably connected with hinges (not visible in this view) to a fourth wall panel 250. The first floor panel, the second floor panel, the first wall panel, the second wall panel, the third wall panel and the fourth wall panel are substantially coplanar. At the building site, the building module is placed on a foundation (or ground) with the core floor panel 240 placed on the foundation (or ground). Floor panel 242 and the second floor panel 244 are unfolded from a folded configuration to an unfolded configuration as shown in FIG. 2B. External wall sections 252 and 254 are formed by unfolding of the respective foldably connected wall panels, as shown in FIGS. 2C-2E (the order of the respective unfolding steps can be different from the order shown here). The ceiling beams 232 and 234 are moved upward into unfolded configuration as shown in FIG. 2F; noting that the step can be performed at other times during the unfolding of the building module; however, as shown here after the external wall sections have been formed. Trapezoidal wall panels 260, one or more central roof panels 215 and one or more butterfly roof panels and frame roof cricket 265 are installed. The building module further exhibits an optional removable soffit panel 268 to make structural, sprinkler, and electrical connections to roof panels and install an optional fire place flue. Additionally, FIGS. 2A-2H illustrate optional, non-structural internal wall panels 270. The wall panels include respective structural steel frame elements, which are formed from structural steel members. Some of these structural steel members are visible in this cross-sectional view, for example, members 272, 274, 276 and 278. Further, these wall panels which form an exterior wall section of a building can include windows, doors and other elements that are typically found in external walls of conventional buildings. For example, wall panels 249 and 250 include windows 280. Typically, connections between finishing materials and finishing elements such as windows to the steel structural frame of the building module are indirect as described herein.

FIGS. 3A-3H and 4A-4H provide schematic cross-sectional views of eight different exemplary embodiments of the building modules of the present invention in folded (FIGS. 3A, 3C, 3E, 3G, 4A, 4C, 4E, and 4G) and unfolded configuration (FIGS. 3B, 3D, 3F, 3H, 4B, 4D, 4F, and 4H), respectively.

Figure 3C:
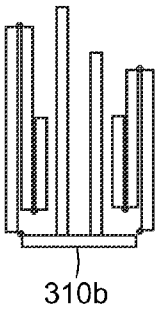
FIGS. 3A-3H is a provide schematic cross-sectional views of four exemplary building module embodiments of the present invention, in folded (FIGS. 3A, 3C, 3E and 3G) and unfolded configuration (FIGS. 3B, 3D, 3F and 3H), respectively.
Figure 3D:
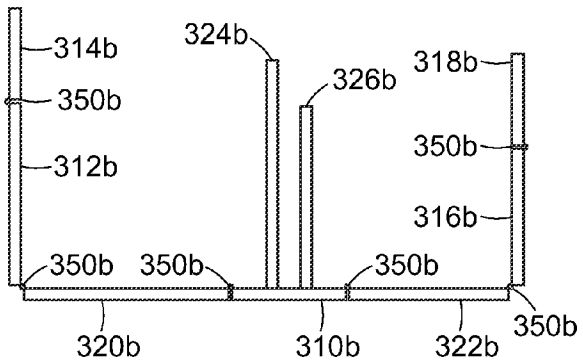
Figure 3A:
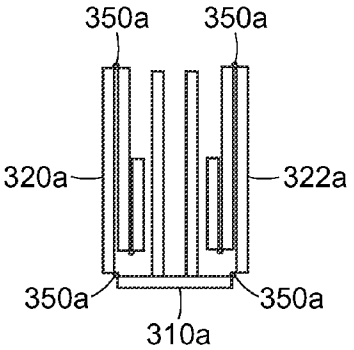
Figure 3B:
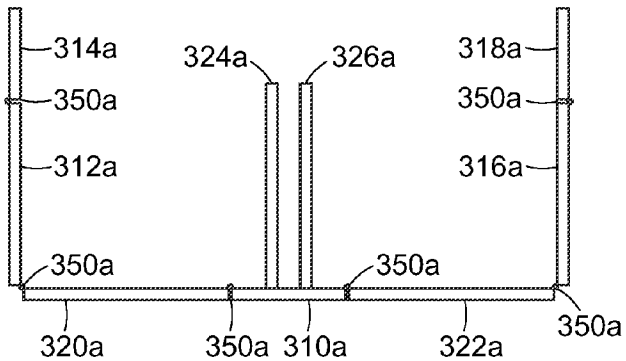

The building module of FIGS. 3A-3B has a core floor frame element (or core floor panel including a core floor frame element) 310*a*. The building module further has a first exterior wall section provided by a first wall frame element (or first wall panel including a first wall frame element) 312*a* foldably connected to a second wall frame element (or second wall panel including a second wall frame element) 314*a*, and a second exterior wall section provided by a third wall frame element (or third wall panel including a third wall frame element) 316*a* foldably connected to a fourth wall frame element (or fourth wall panel including a fourth wall frame element) 316*a*. The first wall frame element (or first wall panel including a first wall frame element) 312*a* further foldably connects to a first floor frame element (or first floor panel including a first floor frame element) 320*a* which itself is foldably connected to the core floor frame element (or core floor panel including a core floor frame element) 310*a*. The third wall frame element (or third wall panel including a third wall frame element) 312*a* further foldably connects to a second floor frame element (or second floor panel including a second floor frame element) 322*a* which itself is foldably connected to the core floor frame element (or core floor panel including a core floor frame element) 310*a*. Two structural support structures (e.g., steel I-beams, or hollow structural steel sections) 324*a* and 326*a* are shown in fixed connection with the core floor frame element 310*a*. Elements 350*a* are the foldable connects (typically, metal hinges). In this embodiment, structural support structures 324*a* and 326*a* are of substantially equal height and centered between two exterior wall sections, which are also of equal height. Further, 320*a* and 322*a* are of substantially equal width. The building module further typically has a rectangular floor analogous to the one of the building module of FIG. 1. Additionally, the building module has further structural support structures at the side opposing the side shown in cross-sectional view, which are not visible in these views.

The building module of FIGS. 3C-3D has a core floor frame element (or core floor panel including a core floor frame element) 310*b*. The building module further has a first exterior wall section provided by a first wall frame element (or first wall panel including a first wall frame element) 312*b* foldably connected to a second wall frame element (or second wall panel including a second wall frame element) 314*b*, and a second exterior wall section provided by a third wall frame element (or third wall panel including a third wall frame element) 316*b* foldably connected to a fourth wall frame element (or fourth wall panel including a fourth wall frame element) 316*b*. The first wall frame element (or first wall panel including a first wall frame element) 312*b* further foldably connects to a first floor frame element (or first floor panel including a first floor frame element) 320*b* which itself is foldably connected to the core floor frame element (or core floor panel including a core floor frame element) 310*b*. The third wall frame element (or third wall panel including a third wall frame element) 312*b* further foldably connects to a second floor frame element (or second floor panel including a second floor frame element) 322*b* which itself is foldably connected to the core floor frame element (or core floor panel including a core floor frame element) 310*b*. Two structural support structures (e.g., steel I-beams, or hollow structural steel sections) 324*b* and 326*b* are shown in fixed connection with the core floor frame element 310*b*. Elements 350*b* are the foldable connects (typically, metal hinges). In this embodiment, structural support structures 324*b* and 326*b* have different heights and are not centered between the two exterior wall sections which are also of different height. Further, 320*b* and 322*b* have different widths. The building module further typically has a rectangular floor analogous to the one of the building module of FIG. 1. Additionally, the building module has further structural support structures at the side opposing the side shown in cross-sectional view, which are not visible in these views The building module of FIGS. 3E-3F has a core floor frame element (or core floor panel including a core floor frame element) 310*c*. The building module further has a first exterior wall section provided by a first wall frame element (or first wall panel including a first wall frame element) 312*c* foldably connected to a second wall frame element (or second wall panel including a second wall frame element) 314*c*, and a second exterior wall section provided by a third wall frame element (or third wall panel including a third wall frame element) 316*c* foldably connected to a fourth wall frame element (or fourth wall panel including a fourth wall frame element) 318*c*. The first wall frame element (or first wall panel including a first wall frame element) 312*c* further foldably connects to a first floor frame element (or first floor panel including a first floor frame element) 320*c* which itself is foldably connected to the core floor frame element (or core floor panel including a core floor frame element) 310*c*. The third wall frame element (or third wall panel including a third wall frame element) 316*c* further foldably connects to a second floor frame element (or second floor panel including a second floor frame element) 322*c* which itself is foldably connected to the core floor frame element (or core floor panel including a core floor frame element) 310*c*. Two structural support structures (e.g., steel I-beams, or hollow structural steel sections) 324*c* and 326*c* are shown in fixed connection with the core floor frame element 310*c*. Elements 350*c* are the foldable connects (typically, metal hinges). In this embodiment, structural support structures 324*c* and 326*c* have different heights and are centered between the two exterior wall sections which are also of substantially equal height; however, have wall frame elements of different height (i.e., 314*c* is shorter than 318*c*, and 312*c* is longer than 316*c*). Further, 320*c* and 322*c* have substantially equal widths. The building module further typically has a rectangular floor analogous to the one of the building module of FIG. 1. Additionally, the building module has further structural support structures at the side opposing the side shown in cross-sectional view, which are not visible in these views.

Figure 3G:
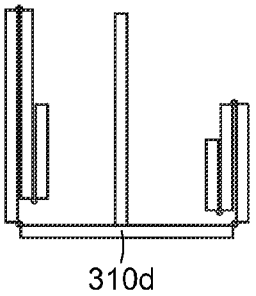
Figure 3H:
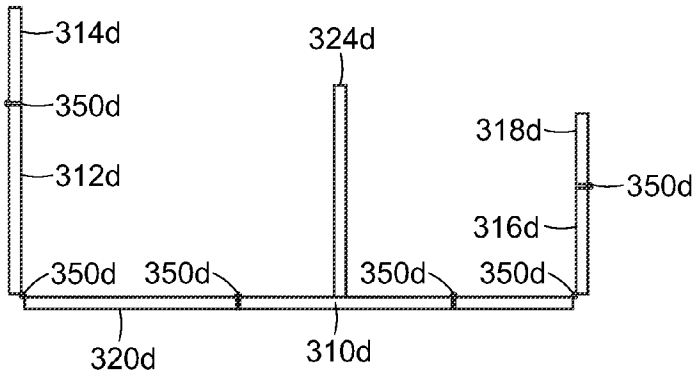
Figure 3E:
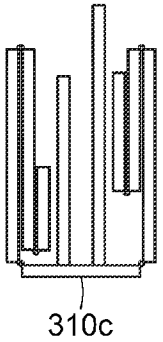
Figure 3F:
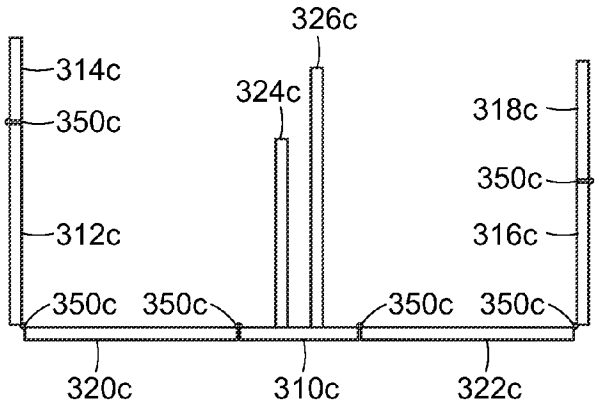

The building module of FIGS. 3G-3H has a core floor frame element (or core floor panel including a core floor frame element) 310*d*. The building module further has a first exterior wall section provided by a first wall frame element (or first wall panel including a first wall frame element) 312*d* foldably connected to a second wall frame element (or second wall panel including a second wall frame element) 314*d*, and a second exterior wall section provided by a third wall frame element (or third wall panel including a third wall frame element) 316*d* foldably connected to a fourth wall frame element (or fourth wall panel including a fourth wall frame element) 318*d*. The first wall frame element (or first wall panel including a first wall frame element) 312*d* further foldably connects to a first floor frame element (or first floor panel including a first floor frame element) 320*d* which itself is foldably connected to the core floor frame element (or core floor panel including a core floor frame element) 310*d*. The third wall frame element (or third wall panel including a third wall frame element) 316*d* further foldably connects to a second floor frame element (or second floor panel including a second floor frame element) 320*d* which itself is foldably connected to the core floor frame element (or core floor panel including a core floor frame element) 310*d*. One structural support structures (e.g., steel I-beams, or hollow structural steel sections) 324*d* is shown in fixed connection with the core floor frame element 310*d*. Elements 350*d* are the foldable connects (typically, metal hinges). In this embodiment, the structural support structure 324*d* is neither centered between the two exterior wall sections nor centered on 310*d*, and the exterior wall sections are of different height. The building module further typically has a rectangular floor analogous to the one of the building module of FIG. 1. Additionally, the building module has further structural support structures at the side opposing the side shown in cross-sectional view, which are not visible in these views.

Figure 4A:
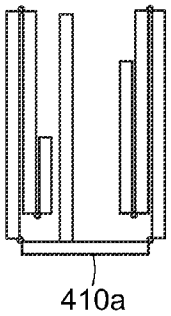
FIGS. 4A-4H provide schematic cross-sectional views of four exemplary building module embodiments of the present invention, in folded (FIGS. 4A, 4C, 4E and 4G) and unfolded configuration (FIGS. 4B, 4D, 4F and 4H), respectively.
Figure 4C:
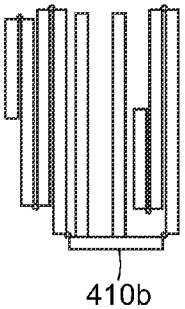
Figure 4B:
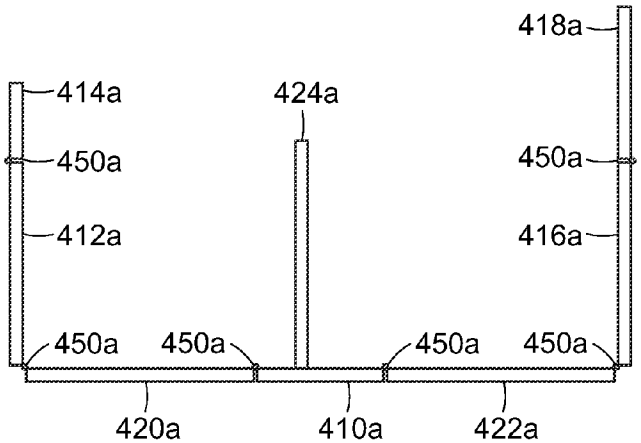

The building module of FIGS. 4A-4B has a core floor frame element (or core floor panel including a core floor frame element) 410*a*. The building module further has a first exterior wall section provided by a first wall frame element (or first wall panel including a first wall frame element) 412*a* foldably connected to a second wall frame element (or second wall panel including a second wall frame element) 414*a*, and a second exterior wall section provided by a third wall frame element (or third wall panel including a third wall frame element) 416*a* foldably connected to a fourth wall frame element (or fourth wall panel including a fourth wall frame element) 418*a*. The first wall frame element (or first wall panel including a first wall frame element) 412*a* further foldably connects to a first floor frame element (or first floor panel including a first floor frame element) 420*a* which itself is foldably connected to the core floor frame element (or core floor panel including a core floor frame element) 410*a*. The third wall frame element (or third wall panel including a third wall frame element) 416*a* further foldably connects to a second floor frame element (or second floor panel including a second floor frame element) 422*a* which itself is foldably connected to the core floor frame element (or core floor panel including a core floor frame element) 410*a*. A structural support structure (e.g., steel I-beams, or hollow structural steel section) 424*a* is shown in fixed connection with the core floor frame element 410*a*. Elements 450*a* are the foldable connects (typically, metal hinges). In this embodiment, the structural support structure 424*a* is neither centered between the two exterior wall sections or on core floor frame element 410*a*. Further, the exterior wall sections are of different height. Further, 420*a* and 422*a* are of substantially equal width. The building module further typically has a rectangular floor analogous to the one of the building module of FIG. 1. Additionally, the building module has further structural support structures at the side opposing the side shown in cross-sectional view, which are not visible in these views.

Figure 4D:
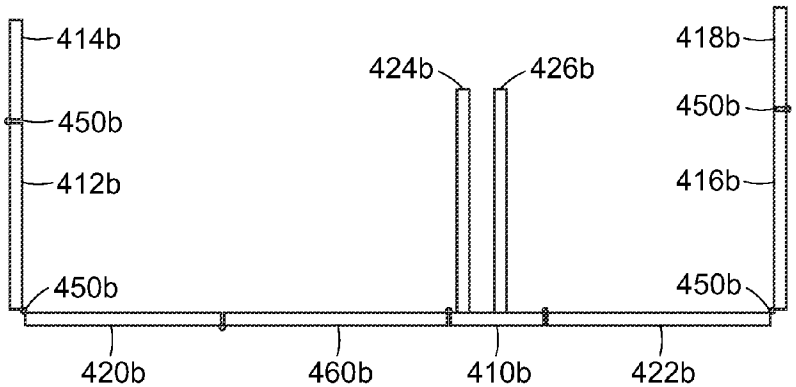

The building module of FIGS. 4C-4D has a core floor frame element (or core floor panel including a core floor frame element) 410*b*. The building module further has a first exterior wall section provided by a first wall frame element (or first wall panel including a first wall frame element) 412*b* foldably connected to a second wall frame element (or second wall panel including a second wall frame element) 414*b*, and a second exterior wall section provided by a third wall frame element (or third wall panel including a third wall frame element) 416*b* foldably connected to a fourth wall frame element (or fourth wall panel including a fourth wall frame element) 418*b*. The first wall frame element (or first wall panel including a first wall frame element) 412*b* further foldably connects to a first floor frame element (or first floor panel including a first floor frame element) 420*b*. The first floor frame element (or first floor panel including a first floor frame element) 420*b* is foldably connected to a further floor frame element (or further floor panel including the further floor frame element) 460*b*, which itself is foldably connected to the core floor frame element (or core floor panel including a core floor frame element) 410*b*. The third wall frame element (or third wall panel including a third wall frame element) 416*b* further foldably connects to a second floor frame element (or second floor panel including a second floor frame element) 422*b* which itself is foldably connected to the core floor frame element (or core floor panel including a core floor frame element) 410*b*. Two structural support structures (e.g., steel I-beams, or hollow structural steel sections) 424*b* and 426*b* are shown in fixed connection with the core floor frame element 410*b*. Elements 450*b* are the foldable connects (typically, metal hinges). In this embodiment, structural support structures 424*b* and 426*b* have substantially equal heights but are neither centered between the two exterior wall sections nor on the core floor frame element 410*b*; however, the exterior wall sections are of substantially equal height. Further, 420*b* and 422*b* have different widths. The building module further typically has a rectangular floor analogous to the one of the building module of FIG. 1. Additionally, the building module has further structural support structures at the side opposing the side shown in cross-sectional view, which are not visible in these views.

Figure 4G:
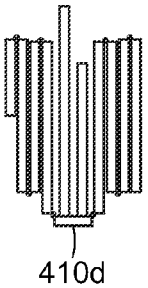
Figure 4H:
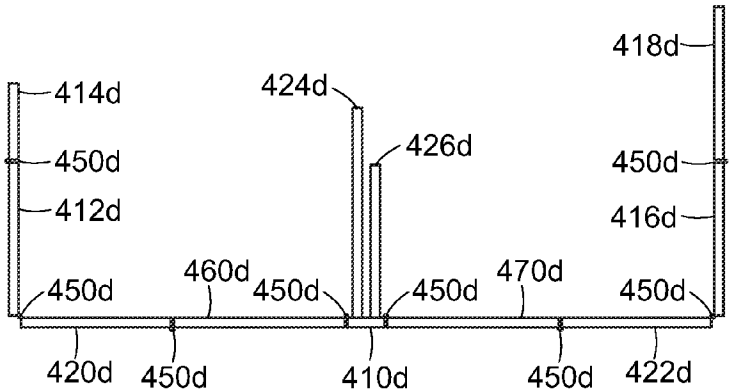
Figure 4E:
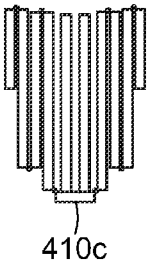
Figure 4F:
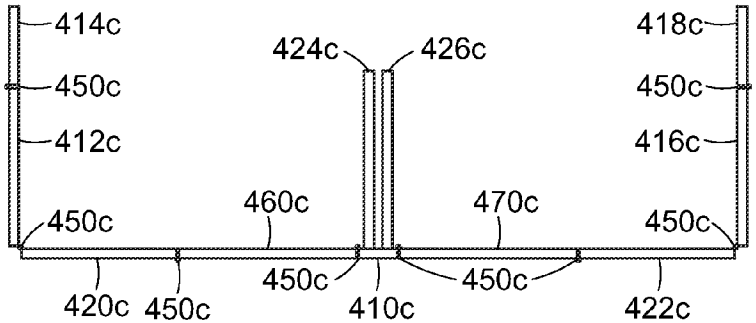

The building module of FIGS. 4E-4F has a core floor frame element (or core floor panel including a core floor frame element) 410*c* which is dimensioned to allow connection of support structures; however, minimized in width to allow compact folding. The building module further has a first exterior wall section provided by a first wall frame element (or first wall panel including a first wall frame element) 412*c* foldably connected to a second wall frame element (or second wall panel including a second wall frame element) 414*c*, and a second exterior wall section provided by a third wall frame element (or third wall panel including a third wall frame element) 416*c* foldably connected to a fourth wall frame element (or fourth wall panel including a fourth wall frame element) 418*c*. The first wall frame element (or first wall panel including a first wall frame element) 412*c* further foldably connects to a first floor frame element (or first floor panel including a first floor frame element) 420*c*. The first floor frame element 420*c* is further foldably connected to a further floor frame element 460*c* which itself is foldably connected to the core floor frame element (or core floor panel including a core floor frame element) 410*c*. The third wall frame element (or third wall panel including a third wall frame element) 416*c* further foldably connects to a second floor frame element (or second floor panel including a second floor frame element) 422*c*. The second floor frame element is foldably connected to a further floor frame element 470*c* which itself is foldably connected to the core floor frame element (or core floor panel including a core floor frame element) 410*c*. Two structural support structures (e.g., steel I-beams, or hollow structural steel sections) 424*c* and 426*c* are shown in fixed connection with the core floor frame element 410*c*. Elements 450*c* are the foldable connects (typically, metal hinges). In this embodiment, structural support structures 424*c* and 426*c* have substantially equal heights and are centered between the two exterior wall sections which are also of substantially equal height. Further, 420*c* and 422*c*, as well as 460*c* and 470*c* have substantially equal widths. The building module further typically has a rectangular floor analogous to the one of the building module of FIG. 1. Additionally, the building module has further structural support structures at the side opposing the side shown in cross-sectional view, which are not visible in these views.

The building module of FIGS. 4G-4H has a core floor frame element (or core floor panel including a core floor frame element) 410*d* which is dimensioned to allow connection of support structures; however, minimized in width to allow compact folding. The building module further has a first exterior wall section provided by a first wall frame element (or first wall panel including a first wall frame element) 412*d* foldably connected to a second wall frame element (or second wall panel including a second wall frame element) 414*d*, and a second exterior wall section provided by a third wall frame element (or third wall panel including a third wall frame element) 416*d* foldably connected to a fourth wall frame element (or fourth wall panel including a fourth wall frame element) 418*d*. The first wall frame element (or first wall panel including a first wall frame element) 412*d* further foldably connects to a first floor frame element (or first floor panel including a first floor frame element) 420*d*. The first floor frame element is further foldably connected to a further floor frame element 460*d* which itself is foldably connected to the core floor frame element (or core floor panel including a core floor frame element) 410*d*. The third wall frame element (or third wall panel including a third wall frame element) 416*d* further foldably connects to a second floor frame element (or second floor panel including a second floor frame element) 422*d*. The second floor frame element is foldably connected to a further floor frame element 470*d* which itself is foldably connected to the core floor frame element (or core floor panel including a core floor frame element) 410*d*. Two structural support structures (e.g., steel I-beams, or hollow structural steel sections) 424*d* and 426*d* are shown in fixed connection with the core floor frame element 410*d*. Elements 450*d* are the foldable connects (typically, metal hinges). In this embodiment, structural support structures 424*d* and 426*d* have different heights, and are centered between the two exterior wall sections which also have different heights. Further, 420*d* and 422*d*, as well as 460*d* and 470*d* have substantially equal widths. The building module further typically has a rectangular floor analogous to the one of the building module of FIG. 1. Additionally, the building module has further structural support structures at the side opposing the side shown in cross-sectional view, which are not visible in these views.

The building modules of the present invention include a first external wall section and a second external wall section (e.g., in folded configuration for transport or in unfolded configuration for finishing at the building site). Typically, the first and second external wall sections each have two horizontally foldably connected wall frame elements. More typically, the first and second external wall sections each have two horizontally foldably connected wall frame elements, and the first and second external wall sections are substantially coplanar. Even more typically, the first and second external wall sections each have two horizontally foldably connected wall frame elements, the first and second external wall sections are substantially coplanar, and the building module has a substantially rectangular floor with the first external wall sections extending entirely along one side of the floor and the second external wall section extending entirely along the opposite side. Yet even more typically, the first and second external wall sections each have two horizontally foldably connected wall frame elements, the first and second external wall sections are substantially coplanar, and the building module has a substantially rectangular floor with the first external wall sections extending entirely along one side of the floor and the second external wall section extending entirely along the opposite side. The building modules of the present invention in unfolded configuration and substantially finished condition, include a ceiling structure, typically, positioned centrally between the first and second external wall sections. The ceiling structure can include one or more structural ceiling beams (transverse beams), typically, structural steel ceiling beams and respective structural steel support structures adapted to support one or more roof panels in the central area of the building module. Typically, the ceiling structure extends along substantially the entire length from one side between the first and second external wall sections to the corresponding opposing side of the building module between the first and second wall sections of the building module, and is connected to respective structural support structures which are connected to a core floor frame element, typically, by fixed connection of structural load carrying steel members of the support structures to outer structural load carrying steel members of the core floor frame element. These embodiments allow for wide open spaces of the building modules.

A ceiling beam of the ceiling structure can be present in a folded building module either in fixed connection, directly or indirectly, to the structural support structures, or foldably connected, for example, with metal hinges, or can be absent or disconnected in a folded building module. Foldably connected ceiling beams are typically dimensioned such that they extend higher above the floor when in unfolded configuration than when folded. This allows for higher ceiling heights along the ceiling beam. In preferred embodiments, the ceiling structure includes two ceiling beams.

A first specific embodiment of the present invention is a building module as described in the first, second, third or eighth embodiment, wherein in unfolded configuration of the building module, the first and second external wall sections each independently extend higher than a top surface of the ceiling structure. Particularly, the first and second external wall sections are substantially coplanar. More particularly, the first and second external wall sections are substantially coplanar, and the building module has a substantially rectangular floor with the first external wall sections extending entirely along one side of the floor and the second external wall section extending entirely along the opposite side.

A second specific embodiment of the present invention is a building module as described in the first, second, third or eighth embodiment, wherein the wall and floor frame elements are part of respective wall and floor panels that are typically, in substantially finished condition.

A third specific embodiment of the present invention is a building module as described in the first, second, third or eighth embodiment, wherein in unfolded configuration of the building module the first and second external wall sections each independently extend higher than the ceiling structure.

A fourth specific embodiment of the present invention is a building module as described in the first, second, third or eighth embodiment, wherein the ceiling structure, if present, includes a ceiling beam that is foldably connected to the respective structural support structures and is unfolded upwards in unfolded configuration of the building module.

A fifth specific embodiment of the present invention is a building module as described in the fourth specific embodiment, wherein the ceiling structure further includes a second ceiling beam supported by respective structural support structures connected to the core floor frame element; wherein the second ceiling beam is foldably connected to the respective structural support structures and is unfolded upwards in unfolded configuration of the building module.

A sixth specific embodiment of the present invention is a building module as described in the first, second, or eighth embodiment, wherein the building module, further comprising a roof structurally supported by the ceiling structure and the first and second exterior wall sections.

A seventh specific embodiment of the present invention is a building module as described in the first, second, third or eighth embodiment, wherein the building module further comprising a first floor frame element foldably connected to the first wall frame element and a second floor frame element foldably connected to the third wall frame element.

An eighth specific embodiment of the present invention is a building module as described in the seventh specific embodiment, wherein the first floor panel, the first wall panel and the second wall panel are foldably connected such that the first floor frame element, the first wall frame element and the second wall frame element are substantially coplanar in folded configuration of the building module; and the second floor frame element, the third wall frame element and the fourth wall frame element are foldably connected such that the first floor frame element, the first wall frame element and the second wall frame element are substantially coplanar in folded configuration of the building module.

A ninth specific embodiment of the present invention is a building module as described in the first, second, third, eighth embodiment, or the sixth or seventh specific embodiment, wherein the ceiling structure is connected to respective structural support structures which are connected to the core floor frame element, the ceiling structure having a top surface that is substantially equidistant from the core floor lengthwise along the ceiling structure, and the ceiling structure is substantially parallel to the first external wall section and the second external wall section; the first external wall section and the second external wall section are interconnected through one or more frame elements including the core floor frame element, and, in unfolded configuration of the building module, the first and second external wall sections each independently extend higher than the top surface of the ceiling structure.

A tenth specific embodiment of the present invention is a building module as described in the first, second, or third embodiment, wherein the first floor frame element, the first wall frame element and the second wall frame element are dimensioned and foldably interconnected such that, in folded configuration of the building module, the first floor frame element provides at least part of a first exterior side; the second floor frame element, the third wall frame element and the fourth wall frame element are dimensioned and foldably interconnected such that, in folded configuration of the building module, the second floor frame element provides at least part of a second exterior side; and the core floor section provides at least part of a third exterior side.

An $11^{th}$ specific embodiment of the present invention is a building module as described in the first, second, third, seventh or eighth embodiment, wherein the first exterior side and the second exterior side of the building module in folded configuration are substantially coplanar and the width between the first exterior side and the second exterior side is about 8 feet and 6 inches or less.

A $12^{th}$ specific embodiment of the present invention is a building module as described in the first, second, third, seventh or eighth embodiment, wherein each ceiling structure, if present, extends along substantially the entire length from the side between the first and second external wall sections to the corresponding opposing side of the building module between the first and second wall sections side of the building module.

A $13^{th}$ specific embodiment of the present invention is a building module as described in the first, second, third, seventh or eighth embodiment, wherein each ceiling structure, if present, is connected to a first structural support member on one end of the ceiling structure and to a second structural support member at the other end of the ceiling structure, to form a space without structural support underneath the ceiling structure.

A $14^{th}$ specific embodiment of the present invention is a building module as described in the first, second, third, seventh or eighth embodiment, wherein the first wall frame element includes a structural steel member, the second wall frame element includes a structural steel member, the third wall frame element includes a structural steel member, and the fourth wall frame element includes a structural steel member, and the frame elements are foldably connected with metal hinges attached to the structural steel members.

A $15^{th}$ specific embodiment of the present invention is a building comprising a building module of the first embodiment, second embodiment, third embodiment, seventh embodiment, eighth embodiment, first specific embodiment, second specific embodiment, third specific embodiment, fourth specific embodiment, fifth specific embodiment, sixth specific embodiment, seventh specific embodiment, eighth specific embodiment, ninth specific embodiment, $10^{th}$ specific embodiment, $11^{th}$ specific embodiment, $12^{th}$ specific embodiment, $13^{th}$ specific embodiment or $14^{th}$ specific embodiment, in unfolded configuration, and, connected to a building unit along a side between the first and second external wall section. In a particular embodiment, the building unit is a foldable building unit. In a more particular embodiment, the building unit is a further building module according to the embodiments described herein.

A $16^{th}$ specific embodiment of the present invention is a building comprising a building module of the first embodiment, second embodiment, third embodiment, seventh embodiment, eighth embodiment, first specific embodiment, second specific embodiment, third specific embodiment, fourth specific embodiment, fifth specific embodiment, sixth specific embodiment, seventh specific embodiment, eighth specific embodiment, ninth specific embodiment, $10^{th}$ specific embodiment, $11^{th}$ specific embodiment, $12^{th}$ specific embodiment, $13^{th}$ specific embodiment or $14^{th}$ specific embodiment, in unfolded configuration, one or more roof panels providing a roof for the building module, and one or more exterior wall panels (typically, non-structural) providing walls for any open side of the building module after unfolding into unfolded configuration. Typically, the roof panels and the one or more exterior wall panels are not part of the building module in folded configuration.

Although FIG. 1 and FIGS. 3A-3H focus on the structural frame elements and respective structural steel members of the building module, it is to be understood that, typically, the structural frame elements are part of respective panels which can include interior and/or exterior finishing materials or elements. Also, typically, the building unit(s) and building modules with roof panels attached complement each other to form a substantially finished house including even kitchen elements including but not limited to cabinets, appliances, and sink(s), and/or bathroom elements including but not limited to cabinets, shower, bathtub, toilet, and sink.

The building modules of the present invention in folded configuration (i.e., folded building modules), can include fixed structural frame elements such as ceiling structure 130 in FIG. 1. Alternatively, for example, fixed structures such as ceiling structure 130 can be disconnected from the folded building module and connected to the respective support structures, for example, 140 in FIG. 1 at the building site. Typically, the building modules include folding panels in an arrangement that allows the building modules to be folded into a folded configuration (typically, of box shape) that takes up a smaller volume, primarily, for transport purposes. Such a building module can be unfolded to result in an unfolded building module.

The individual structural frame elements of the building module are typically made from a number of structural steel members in fixed connection. The structural steel members of different structural frame elements can be connected to provide a fixed connection of the structural frame elements in both folded and unfolded configuration of the folding building module, or can be foldably connected to provide a foldable connection of the structural frame elements and thereby allow folding and unfolding of the folding building module. After unfolding and affixing of the structural frame elements through connection of respective structural steel members, the structural frame elements form at least part of the structural frame of the building (e.g, house).

The buildings of the present invention can be formed, in part or substantially completely, from a building module of the present invention. More typically, the buildings of the present invention can be formed, in part or substantially completely, from a building module of the present invention and one or more building units adapted to connect to open sides of the building module. Typically, the building modules of the present invention have two open sides thereby allowing to connect between two other building units, which, generally, can be foldable building units or further building modules of the present invention. Accordingly, the number of building modules and units is not limited in principal; however, typically, the buildings include up to one hundred complementary unfolding building modules, more typically, up to ten, and even more typically, (i) one building module and two interconnected building units, (ii) one building module and one connected building unit, or (iii) one building module. Most typically, the buildings are formed from one building module and two interconnected building units. With regard to cases (ii) and (iii), typically, wall panels that are not part of the folded building module close any open side of the building module. Typically, the building units are connected to the building module without substantial structural redundancy and structurally interdependently.

The building modules of the present invention can be prefabricated such that the building module, after unfolding on the building site and connecting of removable sections (such as roof elements and non-structural interior walls), are substantially in finished condition, not considering any open sides of the building modules which are adapted for connecting with building units and/or wall panels. That is, they do not typically require or at least significantly reduce the addition of interior and exterior finish materials with the exception of minor, non-structural finishing in areas required for folding movement. Further, typically, the houses of the present invention include roof sections that are panelized but can be easily installed at the building site. The prefabrication process can be reduced substantially, even to the extent that merely folding structural frames of the present invention are prefabricated and unfolded and connected at the building site.

Further, all necessary mechanical and electrical systems for the residential or commercial foldable building, for example, all the required appliances and plumbing fixtures, can be installed in a core part (or structure) (i.e., a part of the structural frame of the foldable building that is made of frame elements that are not unfolded at the building site). Flexible piping and wiring can also be chased throughout both fixed and foldably connected panels of the foldable building units of the present invention.

Use of structural steel in the form of appropriately dimensioned I-beams, c-channels, wide-flange beams, and hollow structural sections allows for large frame geometries as part of the structural frame of the foldable building unit, for example, rectangular frame elements spanning the entire side of a foldable building, reducing prefabrication cost and/or simplifying unfolding at the building site.

Further, foldable structural frames substantially made of metal frame elements (e.g., made from hot-formed steel such as I-beams, c-channels, wide-flange beams, and hollow structural sections) can be prefabricated to superior tolerances such that a respective folding building module in substantially finished condition upon unfolding exhibits reduced or no gaps in the seam areas between foldably connected frame elements thereby reducing the work associated with on-site finishing of these seam areas.

Structural steel frames of the present invention are typically combined with wooden or light-gauge metal intermediate elements to form lightweight steel and wood/light-gauge metal hybrid structures as part of fixed or foldable panels, in which the frame elements provide structural stability and the wooden or light-gauge metal intermediate elements provide substantial lateral structural resistance and/or are used to attach interior and exterior finishing material or elements using standard construction approaches, reducing labor training and associated costs.

In certain embodiments of the present invention, structural steel members connecting different structural frame elements allow blocking material (e.g. wood or light-gauge metal studs) to be connected to the structural steel members (preferably, inside areas, if present, of the structural steel members), and the structural steel members are positioned such that the blocking members face the outside of the foldable building unit. This allows structural frames that have a continuous conventional structural grid (e.g., 16 inch wood lumber grid) through the edges/corners of the folding building module, thereby allowing attachment of exterior finishing material through the edges/corners using standard construction approaches, reducing labor training and associated costs, and work at the building site.

Use of these strong and lightweight structures can also substantially reduce the amount of required building material and the weight of the frame elements, which in turn facilitates the transport of larger folded building modules for a given maximal allowed weight according to given road regulations.

Indirect connections of interior and/or exterior finishing materials to metal frame elements (particularly, frame elements made of structural steel sections) are one aspect of a "multi-tolerance" building approach that disaggregates and cushions brittle or otherwise fragile finish materials from the vibrational, kinetic and settling forces applied to the structural frame during shipping, setting, unfolding and settling of the prefabricated foldable building units. A second aspect of a multi-tolerance building approach is provided by using offset hinges (in particular, L-shaped offset hinges) which are specifically engineered to safely nest hingedly (i.e., foldably connected with one or more hinges) connected frame elements at a designed distance away from its neighboring frame element, allowing, for example, for thicker wall depths and thus the prefabricated inclusion of finish materials. This is associated with a significant reduction in the scope of work to be completed on-site, where costs and scheduling are far less manageable. Accordingly, the building modules of the present invention can include final interior finishing, such as trim, gypsum board, paint or wallpaper.

Structural steel members of the present invention can be foldably connected with hinges to foldably connect frame elements and respective panels. More typically, structural steel members of the present invention can be foldably connected with offset hinges, and preferably, L-shaped offset hinges adapted and positioned to remain within the building envelope. In completely folded configuration of foldably connected panels, L-shaped offset hinges provide an offset, which allows sufficient clearance for finish and other materials. Further, the interior finish materials attached to the frame elements can be sufficiently offset from each other to avoid direct and potentially damaging contact, for example, during transport.

A building module in "unfolded configuration" is a foldable building unit in which the foldably connected structural frame elements have been unfolded into positions that can be maintained in the finished condition of the resulting building. A folding building module in "folded configuration" is a folding building module in which foldably connected frame elements are folded into positions suitable for uploading, transport, and/or unloading of the building unit.

A "structural frame" as used herein, refers to the totality of structural steel members of a building module or building that are primarily responsible for providing structural stability of the building module or building by transmitting loads (e.g., static, dynamic, and/or vibrational loads) to the ground. Structural frames can include members that are made of a plurality of materials in various forms and dimensions. Suitable materials that can be used include but are not limited to metal (e.g., aluminum or steel), wood and polymers. Typically, steel is used.

Suitable structural steel members include but are not limited to hollow structural sections, C-channels (with or without return), I-beams (including S and W type), T-beams, angle beams, and wide-flange beams. For example, the structural steel members can be commercially available American standard structural steel members. The selection of a material, form and dimension for a given structural part or member of a structural frame is interdependent and depends on factors such as the position of the structural part or member in the structural frame, and whether the member is part of a frame element that is foldably connected.

In the context of the shape of structural steel member, "inside", "inside area", "interior area", "inside surface" or "interior surface" refers to the areas of the structural steel member that are inside of a box enveloping the structural steel member. That is, if a cross-sectional view of the structural steel member is considered any part of the perimeter of the structural steel member that is inside of a rectangle enveloping (i.e., with minimum perimeter length of the rectangle) the structural steel member corresponds to the "inside", an "inside area", an "interior area", an "inside surface" or an "interior surface."

Interior and exterior finish materials can be attached to the structural frame, typically, by attachment with intermediate elements affixed to frame elements of the structural frame. Interior and exterior finishing materials are typically attached (e.g., glued, nailed, screwed, welded and/or bolted, or otherwise affixed) to intermediate elements. Interior finish materials include but are not limited to wall finishing (for example, gypsum board), ceiling finishing and floor finishing (for example, sheathing with Bamboo flooring on top). Exterior finishing elements include but are not limited to siding and roofing.

For finish materials, and, in particular, interior finish materials, it has been found that "indirect connection" to the frame elements to reduce contact, partially or entirely, of the interior finish materials with the frame elements is advantageous for one or more of the following reasons. Reduced contact can (a) reduce the transfer of structural stresses from one or more frame elements of the structural frame to the often fragile and brittle interior finish materials thereby reducing or eliminating significant damage (such as dry wall cracking) of the interior finish materials, in particular, during folding, uploading, transporting, unloading and/or unfolding of the foldable building unit, and settling, (b) reduce or eliminate the exposure of the interior finish materials to water, for example, water that can condensate on metal parts of the frame elements, and (c) reduce heat transfer between the inside of the finished building unit to the outside of the finished building unit.

Thus, generally, it is preferred to use indirect rather than direct connections of finish materials, particularly, interior finish materials with respective frame elements. However, even though indirect connections are typically preferred, not all connections between interior finish material and a respective frame element have to be indirect.

Typically, intermediate elements are made, at least in part, of materials that have a force cushioning effect, that is, force cushioning elements such as, for example, wood, sprayed foam, and light-gauge metal studs. Typically, an intermediate element is positioned and dimensioned such that it can connect or can be connected (e.g., using powder-actuated fasteners or self-tapping screws) to the frame element through one area of the intermediate element (e.g., through one side of the intermediate element) and that it can be connected to the finish material, particularly, the interior finish material (for example, using nails or screws) through another area of the intermediate element (e.g., through another side of the intermediate element). Even more preferably, intermediate elements are entirely made of force cushioning materials such as wood.

Typically, folded building modules of the present invention can include wall panels, roof panels and/or floor panels/sections that are in substantially finished condition, that is, with the exception of unfinished areas dimensioned to accommodate folding of the frame elements, and unfinished areas due to wall connection seams (i.e., seams between walls that are not connected but upon unfolding jointly form a wall), these wall panels, roof and/or floor panels are finished.

The folded building modules of the present invention are typically dimensioned such that transport with a transport vehicle is possible, preferably, with a semitrailer and without requiring a special transport permit. Regulations pertaining to the operation of trucks and trailers vary from country to country, and, in some instances from state to state. Typically, the folded building module Further, the folded building modules of the present invention can include one or more folding floor panels which provide one or more exterior walls of the folded building module, which increases stability of the building module in folded configuration, protects prefabricated and finished parts in the core volume, and thereby facilitates transportation of the building module.

Further teaching of the general folding building technology relevant to the present invention is described in International Patent Application No. PCT/US2010/050041, filed Sep. 23, 2010, and published as WO2011/038145, in International Patent Application No. PCT/US2011/029643, filed Mar. 23, 2011, and in International Patent Application No. PCT/US2011/054348, filed Sep. 30, 2011.

The relevant teachings of these patent applications, and all patents, published published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims.

What is claimed:

1. A building module comprising (a) a first external wall section having a first wall frame element foldably connected to a second wall frame element; in unfolded configuration, the first wall frame element providing a bottom part of the first external wall section and the second wall frame element providing a top part of the first external wall section;

(b) a second external wall section having a third wall frame element foldably connected to a fourth wall frame element; in unfolded configuration, the third wall frame element providing a bottom part of the second external wall section and the fourth wall frame element providing a top part of the second external wall section; and (c) a ceiling structure connected to structural support structures, the ceiling structure being positioned in lengthwise orientation from a side of the building module between the first and second external wall sections to a corresponding opposing side of the building module between the first and second wall sections;

wherein the structural support structures each are connected to a core floor frame element, the first external wall section and the second external wall section are interconnected through one or more frame elements including the core floor frame element; wherein in unfolded configuration of the building module the first and second external wall sections each independently extend higher than the ceiling structure.

2. A building module comprising (a) a first external wall section having a first wall frame element foldably connected to a second wall frame element; in unfolded configuration, the first wall frame element providing a bottom part of the first external wall section and the second wall frame element providing a top part of the first external wall section;

(b) a second external wall section having a third wall frame element foldably connected to a fourth wall frame element; in unfolded configuration, the third wall frame element providing a bottom part of the second external wall section and the fourth wall frame element providing a top part of the second external wall section; and (c) a ceiling structure connected to structural support structures, the ceiling structure being positioned in lengthwise orientation from a side of the building module between the first and second external wall sections to a corresponding opposing side of the building module between the first and second wall sections;

wherein the structural support structures each are connected to a core floor frame element, the first external wall section and the second external wall section are interconnected through one or more frame elements including the core floor frame element; wherein the ceiling structure is connected to structural support structures which are connected to the core floor frame element, the ceiling structure having a top surface that is substantially equidistant from the core floor lengthwise along the ceiling structure, and the ceiling structure is substantially parallel to the first external wall section and the second external wall section;

the first external wall section and the second external wall section are interconnected through one or more frame elements including the core floor frame element, and, in unfolded configuration of the building module, the first and second external wall sections each independently extend higher than the top surface of the ceiling structure.

3. A building module comprising (a) a first external wall section having a first wall frame element foldably connected to a second wall frame element; in unfolded configuration, the first wall frame element providing a bottom part of the first external wall section and the second wall frame element providing a top part of the first external wall section;

(b) a second external wall section having a third wall frame element foldably connected to a fourth wall frame element; in unfolded configuration, the third wall frame element providing a bottom part of the second external wall section and the fourth wall frame element providing a top part of the second external wall section; and (c) a ceiling structure connected to structural support structures, the ceiling structure being positioned in lengthwise orientation from a side of the building module between the first and second external wall sections to a corresponding opposing side of the building module between the first and second wall sections;

wherein the structural support structures each are connected to a core floor frame element, the first external wall section and the second external wall section are interconnected through one or more frame elements including the core floor frame element; wherein the ceiling structure is connected to a first structural support structure on one end of the ceiling structure and to a second structural support structure at the other end of the ceiling structure, to form a space without structural support underneath the ceiling structure.

* * * * *